US007445321B2

(12) United States Patent
Lengyel et al.

(10) Patent No.: US 7,445,321 B2
(45) Date of Patent: Nov. 4, 2008

(54) INK-JET CARTRIDGE REMOVAL DEVICE

(75) Inventors: Dennis Michael Lengyel, Ontario, NY (US); Stephen Abb Anderson, Williamson, TN (US)

(73) Assignee: Nukote International, Inc., Franklin, TN (US)

( * ) Notice: Subject to any disclaimer, the term of this patent is extended or adjusted under 35 U.S.C. 154(b) by 251 days.

(21) Appl. No.: 11/126,888

(22) Filed: May 11, 2005

(65) Prior Publication Data

US 2006/0256171 A1 Nov. 16, 2006

(51) Int. Cl.
*B41J 2/175* (2006.01)

(52) U.S. Cl. ..... 347/86

(58) Field of Classification Search ..... 347/86, 347/87

See application file for complete search history.

(56) References Cited

U.S. PATENT DOCUMENTS 5,653,667 A * 8/1997 Reyes ..... 482/121
6,113,230 A * 9/2000 Ishinaga et al. ..... 347/86
6,145,975 A * 11/2000 Kotaki et al. ..... 347/87
6,502,931 B2 * 1/2003 Udagawa et al. ..... 347/86
6,742,879 B2 6/2004 Jones et al.
6,755,515 B2 6/2004 Usui et al.
6,793,330 B2 9/2004 Usui et al.
6,951,389 B2 * 10/2005 Kobayashi et al. ..... 347/86
6,997,548 B2 * 2/2006 Matsuo et al. ..... 347/86
7,104,630 B2 * 9/2006 Steinmetz et al. ..... 347/49
7,178,909 B2 * 2/2007 Yoshiyama et al. ..... 347/86
7,210,772 B2 * 5/2007 Sasaki ..... 347/86

FOREIGN PATENT DOCUMENTS

GB 2 395 684 A 2/2004

* cited by examiner

*Primary Examiner*—Anh T. N. Vo
(74) *Attorney, Agent, or Firm*—Fay Sharpe LLP

(57) ABSTRACT

An ink cartridge has a body having a stepped configuration including a first top wall and a second top wall, wherein the second top wall is lower than the first top wall. A lid has a first position selectively secured to the first top wall and a second portion is secured to the second top wall which forms a ledge for removing the cartridge from a printer. Alternately, a tab extends from a surface of the lid for removing the cartridge from a printhead. Another alternative is indentations formed in the lid and side walls of the cartridge for manually gripping the cartridge for removal from a printhead.

9 Claims, 5 Drawing Sheets

FIG. 6
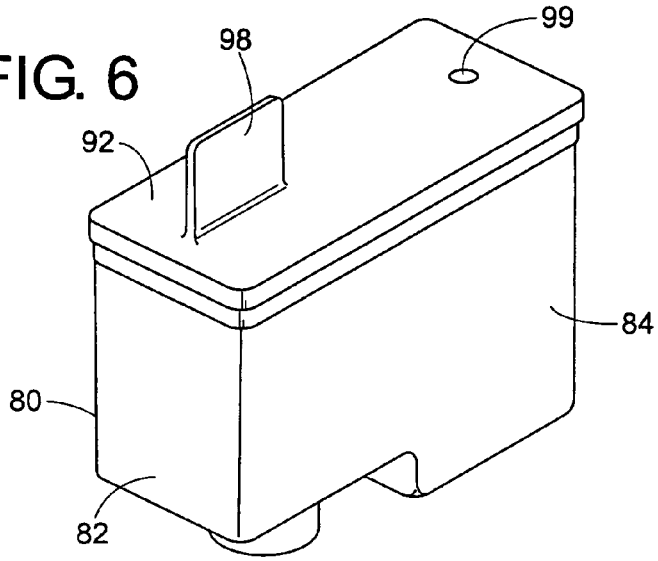
FIG. 9
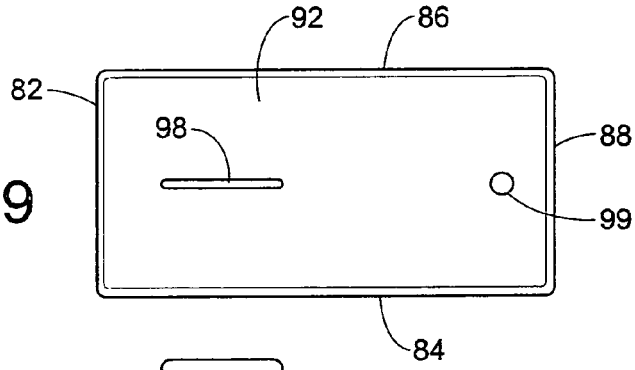
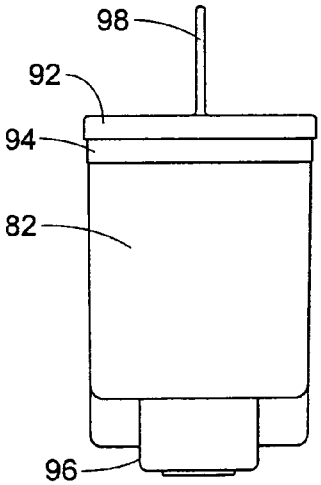
FIG. 8
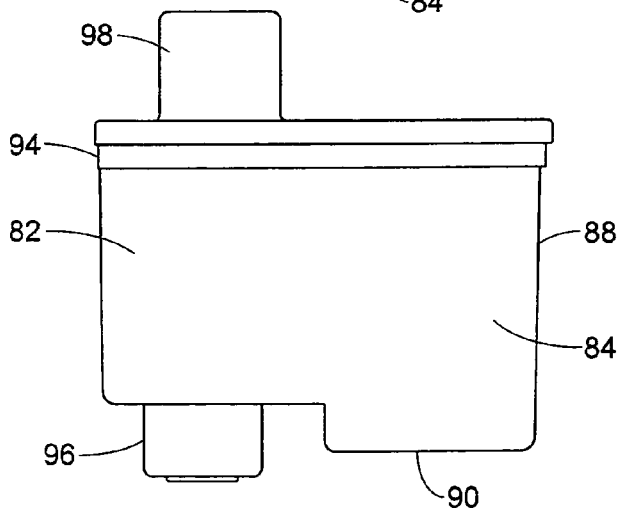
FIG. 7

FIG. 10
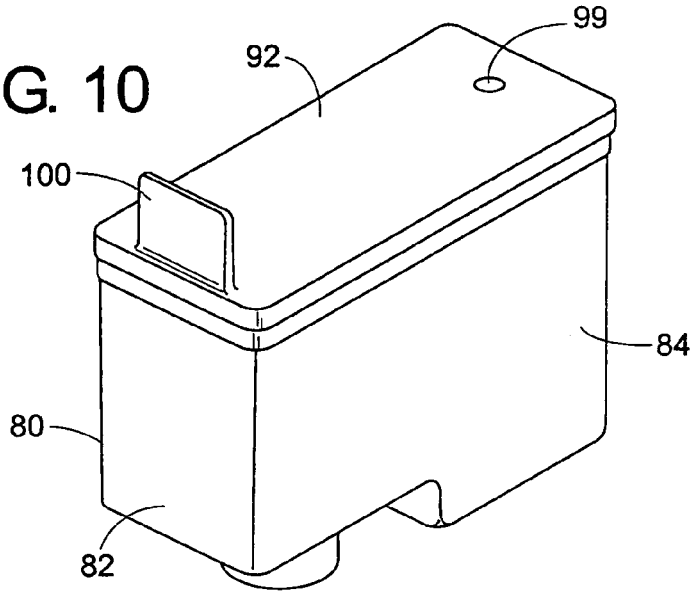
FIG. 13
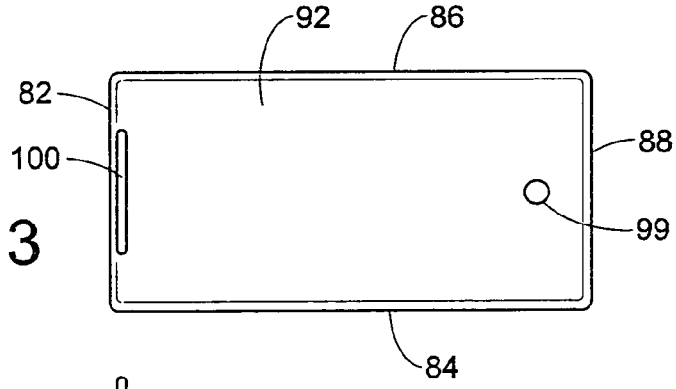
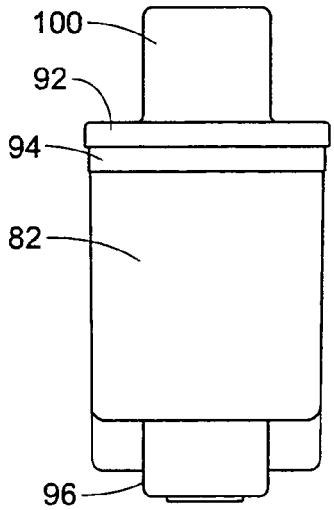
FIG. 12
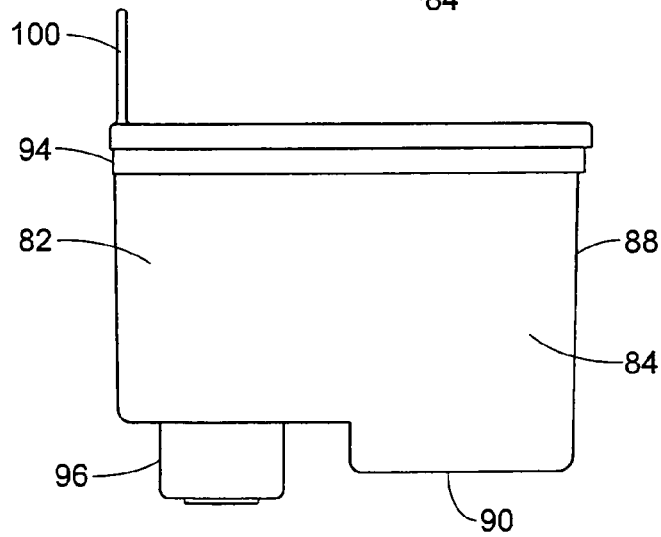
FIG. 11

FIG. 14
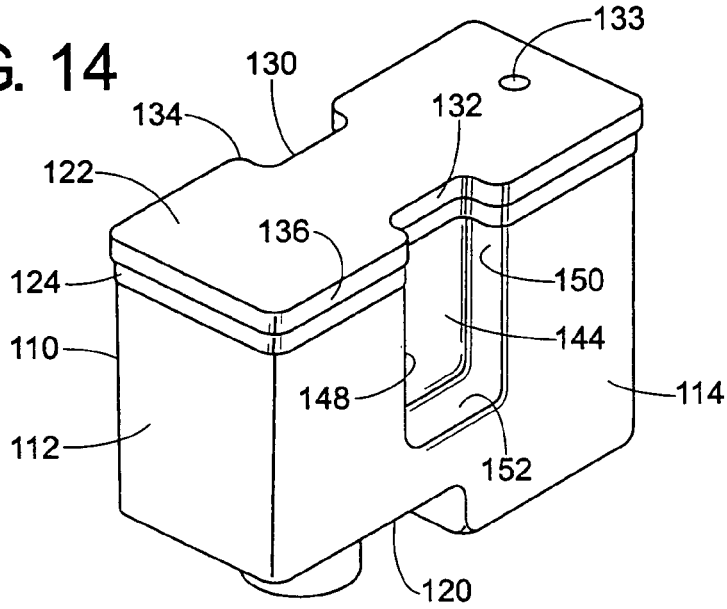
FIG. 17
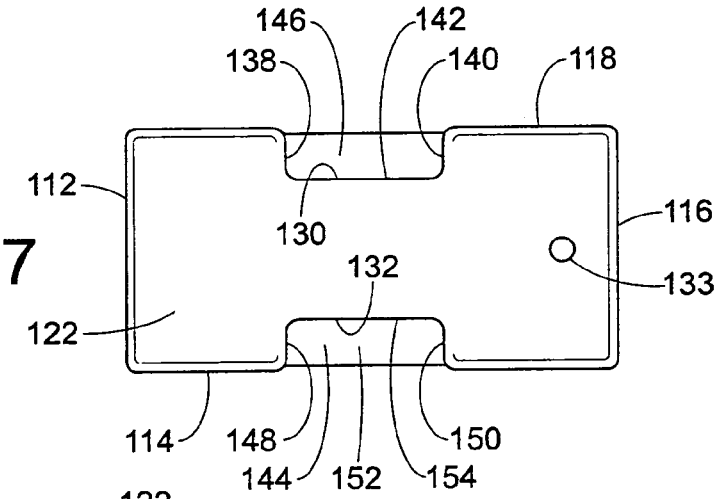
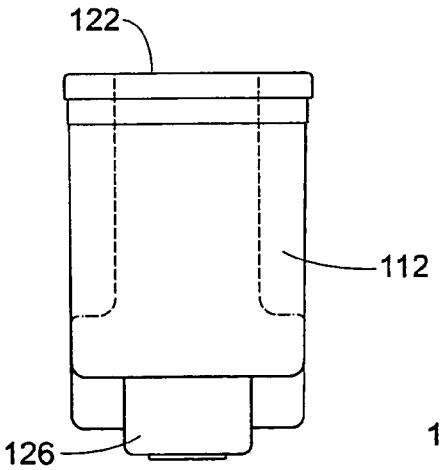
FIG. 16
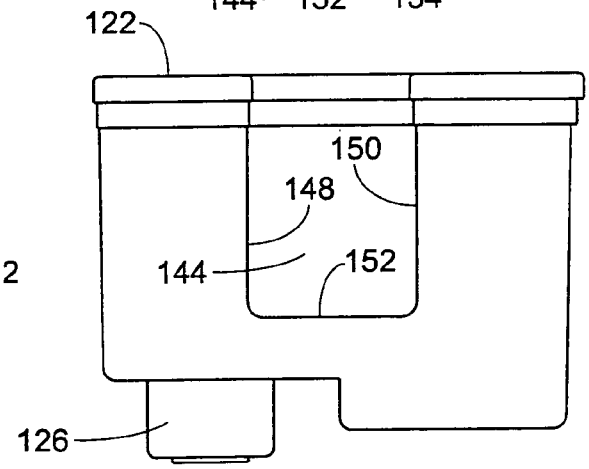
FIG. 15

INK-JET CARTRIDGE REMOVAL DEVICE

BACKGROUND

This application relates generally to the ink-jet printing art for ejecting ink droplets on a recording medium such as paper, and more particularly, to the removal of an ink tank cartridge for use in an ink-jet type recording apparatus such as a printer.

In a conventional recording apparatus, ink is supplied to a recording head from an ink tank constructed as a cartridge. The cartridge can be divided into multiple chambers, where a porous foam or material is positioned over an outlet port in a first chamber and free ink is filled into a second chamber. The free ink migrates from its chamber into the foam through an opening providing communication between the two chambers. The foam then controls the flow of ink as it migrates toward the ink outlet port.

As printers become more compact and smaller, many manufacturers are designing printers which have little space available to easily remove the ink cartridges from the printers by hand. Cartridges typically have molded features which engage and disengage with printhead latch mechanisms to remove the cartridge from the printer. An example of a cartridge with a lever which engages a printhead latch is shown in Patent Application No. GB 2 395 684.

The removal features being built into the cartridge and printhead latch make it difficult to remove the cartridge if the features were to break while installing or removing the cartridge from the printhead.

Furthermore, these molded features, often in the form of projecting portions which engage the printhead, are expensive and time-consuming to produce. Thus, it is desirable to develop a new and improved ink cartridge which provides for easier removal of the cartridge from a printer and provides better, more advantageous results.

SUMMARY OF THE INVENTION

Generally speaking, in accordance with the invention, an ink tank cartridge is provided for an ink-jet type recording apparatus removably mounted on an ink supply needle of a recording body.

More particularly, the invention relates to an ink tank cartridge used for an ink-jet type recording apparatus which is removably mountable on an ink supply needle of the recording apparatus. The ink tank cartridge includes a housing having a bottom wall and a plurality of side walls forming a cavity. A divider wall is positioned within the cavity to divide the cavity into first and second chambers. An ink supply port provides an opening that extends through a bottom wall located in one of the chambers of the housing.

A porous member is accommodated in one of the chambers. The porous member has ink impregnated therein and abuts the opening in the bottom wall. A groove is formed in the bottom wall to direct and transfer ink from the porous member to the ink supply port. The other chamber is partially filled with ink. The divider wall has an opening allowing ink to pass from the ink chamber(s) to the foam chamber.

More particularly, in accordance with one aspect of the invention, an ink cartridge has a body having at least one cavity formed therein; and, a lid secured to an upper end of the body, wherein the lid includes a means for removal of the cartridge from a printhead. A ledge can be formed on the lid to facilitate removal of the cartridge from the printer. A tab extending from a surface of the lid of the cartridge is another structure for facilitating removal of the cartridge from a printer. Another alternative includes indentations formed in side walls of the cartridge body and the lid to enable a user to manually grip and remove the cartridge from the printer.

In accordance with another aspect of the invention, an ink cartridge has a body having a stepped configuration including a first top wall and a second top wall, wherein the second top wall is lower than the first top wall. A first lid is selectively secured to the first top wall. A second lid is selectively secured to the second top wall, wherein the second lid forms a ledge.

In accordance with a still further aspect of the invention, an ink cartridge has a body having a top wall, a bottom wall, and side walls connecting the top wall to the bottom wall. A lid is secured to the top wall. A tab extends from a surface of the lid for removing the cartridge from a printhead.

In accordance with yet another aspect of the invention, an ink cartridge has a body having a top wall, a bottom wall, and the walls connecting the top wall and the bottom wall, and a lid secured to the top wall. The lid has at least one indentation for manually gripping the cartridge for removal from a printhead.

One advantage of the present invention is the provision of a ledge formed in the cartridge lid to facilitate manual removal of the cartridge from a printer.

Another advantage of the present invention is the provision of a tab formed on the cartridge lid to facilitate removal of the cartridge from the printer.

Still another advantage of the present invention is the provision of indentations formed in the lid and side walls of the cartridge to facilitate removal of the cartridge from the printer.

Still other aspects and advantages of the invention will become apparent to those skilled in the art upon reading and understanding the following detailed description.

BRIEF DESCRIPTION OF THE DRAWINGS

The invention may take form in certain components and structures, a preferred embodiment of which will be illustrated in the accompanying drawings wherein:

FIG. 6 is a perspective view of an ink cartridge having a tab extending therefrom in accordance with another embodiment of the present invention;

FIG. 7 is a side elevational view of the ink cartridge of FIG. 6;

FIG. 8 is a front elevational view of the ink cartridge of FIG. 6;

FIG. 9 is a top plan view of the ink cartridge of FIG. 6;

FIG. 10 is a perspective view of an ink cartridge having a tab extending therefrom in accordance with a further embodiment of the present invention;

FIG. 11 is a side elevational view of the ink cartridge of FIG. 10;

FIG. 12 is a front elevational view of the ink cartridge of FIG. 10;

FIG. 13 is a top plan view of the ink cartridge of FIG. 10;

FIG. 14 is a perspective view of an ink cartridge have indentations thereon in accordance with a still further embodiment of the present invention;

FIG. 15 is a side elevational view of the ink cartridge of FIG. 14;

FIG. 16 is a front elevational view of the ink cartridge of FIG. 14;

FIG. 17 is a top plan view of the ink cartridge of FIG. 14;

DETAILED DESCRIPTION OF THE EMBODIMENTS

Figure 1:
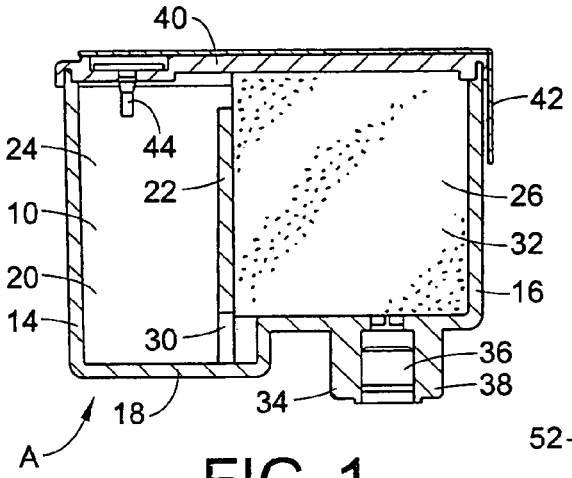
FIG. 1 (PRIOR ART)
FIG. 1 is a side elevational view, in cross-section, of an existing ink cartridge.

Referring now to the drawings, wherein the showings are for purposes of illustrating several embodiments of the invention only and not for purposes of limiting same, FIG. 1 shows a prior art ink tank cartridge illustrating the internal structure of the ink cartridge.

The ink tank cartridge comprises a case or housing 10 which defines an internal cavity of a generally rectangular cross section. The housing has a series of walls including walls 14, 16, and 18 which form an internal cavity 20. An additional dividing wall 22 separates the housing internal cavity into two smaller chambers 24, 26. An opening 30 extends through a lower region of the wall 22 adjacent the bottom wall 18 placing the chambers into communication with each other for ink storage and transfer purposes. Chamber 24 is used to store free ink while chamber 26 is used to store ink in an ink absorbing or porous member 32.

The ink absorbing member typically comprises a block of porous material or foam such as Melamine™ or hydrophilic foam. The absorbing member is disposed in chamber 26 adjacent an outlet port 34 positioned within the bottom wall of the housing. The outlet port 34 comprises an opening 36 and an pipe-like or chimney member 38 which extends from the bottom wall of the housing.

After the ink absorbing member has been installed and properly positioned in the first chamber, a cover 40 is fixedly secured to the housing, for example, by ultrasonic welding. The height of the ink absorbing member is typically slightly less than the inside height of the housing as measured between the bottom wall and the underside of the cover.

The cover can be at least partially sealed with a laminated or plastic seal 42 which is thermally attached over the vent channels of the cover. A fill hole 44 in the cover is initially left unsealed.

The cartridge with a sealed cover assembly is then placed into a holding fixture that effects a seal around the fill hole 44 and a negative pressure or vacuum is applied to the cavity through the fill hole.

Referring now to FIGS. 2-5, an ink cartridge in accordance with one embodiment of the present invention is shown. The ink cartridge B has a ledge formed thereon to facilitate removed of the cartridge from a printer. More specifically, the ink cartridge has a housing 50 having side walls 52, 54, 56, 58 and a bottom wall 60 forming a cavity therein. An outlet port 62 is formed adjacent wall 52 and extends from bottom wall 60. The internal configuration is similar to that shown and described for FIG. 1 and is not described in further detail here.

To facilitate easy removal of the ink cartridge from a printer by hand, a ledge is formed in a lid 64 secured to an upper surface of the cartridge. The lid 64 is divided into two portions, a first portion 65 and a second portion 66. First or upper portion 65 is shown to be positioned above second or lower position 66. Portions 65 and 66 are substantially parallel to each other. Portion 66 can be positioned above a chamber housing an ink absorbing member and upper portion 65 can be positioned above a free-ink chamber. Portion 65 further has a vent or fill hole 67 formed therein.

Lower portion 66 forms a ledge which enables a user to more easily grasp the cartridge and manually remove it from a printer. The ledge is positioned sufficiently low enough on the cartridge body to avoid interference with a printhead latch mechanism which, when in a closed configuration, seats on a top surface of the cartridge lid. The ledge or lower portion 66 enables the user to grasp the cartridge with fingers and remove and lift the cartridge with fingers and remove and lift the cartridge out of the printer.

Figure 2:
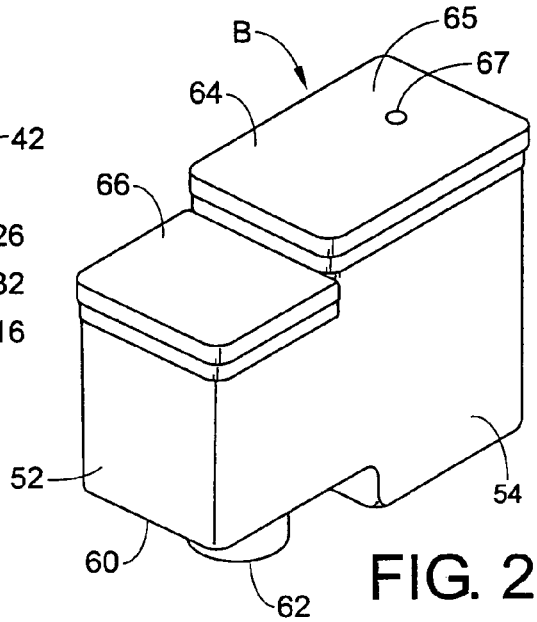
FIG. 2 is a perspective view of an ink cartridge having a ledge formed thereon in accordance with one embodiment of the invention.
Figure 5:
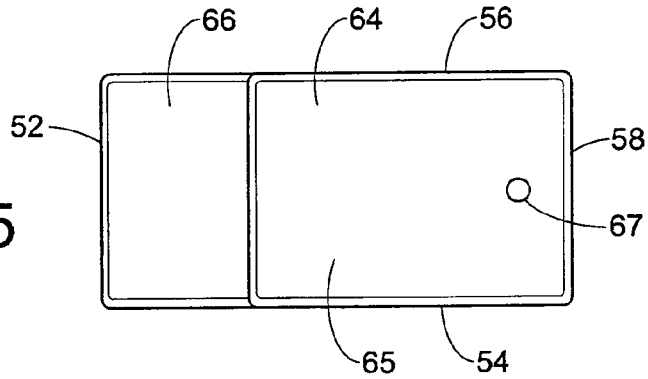
FIG. 5 is a top elevational view of the cartridge of FIG. 2.
Figure 4:
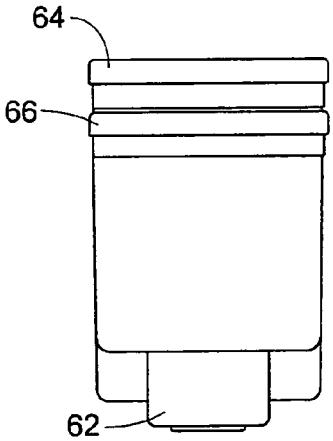
FIG. 4 is a front elevational view of the cartridge of FIG. 2.
Figure 3:
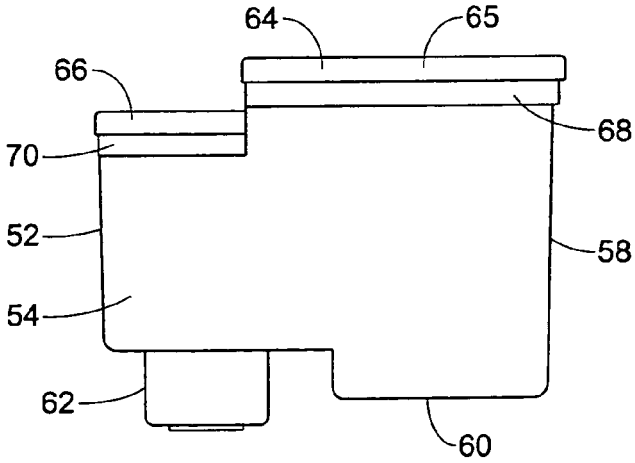
FIG. 3 is a side elevational view of the ink cartridge of FIG. 2.

In the embodiment shown in FIG. 2, the lower portion is positioned about 6 mm, or about 0.25 inches below the upper position to form a ledge. Other positions of the ledge are contemplated without departing from the scope of the invention.

The ink cartridge body itself has a stepped configuration with a first top wall 68 to which first lid portion 65 is installed and a second top wall 70 to which second lid portion 66 is installed. The second lid portion 66 is shown to be substantially smaller in cross section than the first lid portion; however, other dimensions of the second lid portion are also contemplated by the invention. Each lid portion is fixedly secured to the housing, such as by ultrasonic welding.

Referring now to FIG. 6-9, an ink cartridge in accordance with a second embodiment of the present invention is shown. An ink cartridge 80 has side walls 82, 84 86, 88 and a bottom wall 90 which together form an ink cartridge body. A lid 92 is fixedly secured onto a top wall 94 of the cartridge. An outlet port 96 is formed adjacent wall 82 and extends from bottom wall 90. A vent or fill opening 99 is formed in the lid.

Extending upwardly from the lid is a tab 98. The tab can be made of any resilient material, such as plastic, which is conformable and avoids interference with the printhead latch mechanism which, when closed, rests on a top surface of the lid. The tab is shown to be of a square configuration; however, other shapes are also contemplated by the invention. The tab is manually pulled by a user to enable the cartridge to be removed from the printer in an angular or tilted motion.

Referring to FIGS. 10-13, another embodiment of the ink cartridge is shown, wherein a tab 100 is found adjacent side wall 82 of the ink cartridge 80.

The ink cartridge components are virtually the same as through shown in FIGS. 6-9 and thus like references numerals are used. The tab 100 is positioned about 90° with respect to the position of tab 98 shown in FIGS. 6-9.

The position of the tab 100 presents an alternative method of manually pulling the ink cartridge from the printer. The tab 100 is also conformable and resists tearing or breakage. The tab is positioned to avoid interference with the printhead latch mechanism which, when closed, rests on a top surface of the lid.

As an alternate to a tab, a piece of resilient tape can be secured to the cartridge lid in positions illustrated in FIGS. 6 and 10.

Referring now to FIGS. 14-17, a further embodiment of the ink cartridge according to the present invention is shown. An ink cartridge 110 has side walls 112, 114, 116, 118 and a bottom wall 120 which together form a body of the ink cartridge. A lid 122 is fixedly secured to a top edge 124 of the ink cartridge body. An outlet port 126 is formed adjacent side wall 112 and extends from bottom wall 120. A vent or fill hole 133 is formed in the lid.

Lid 122 is formed with two indentations 130, 132 formed on opposite sides 134, 136 of the lid. The indentations are shown to have two side walls 138, 140 and a centered wall 142 disposed therebetween.

Indentations or cavities 144, 146 are formed in opposite side walls 114, 118 of the cartridge body as well. Each indentation 144, 146 has side walls 148, 150 and a bottom wall 152 formed therebetween. A back wall 154 is also formed between side walls 148, 150.

Figure 20:
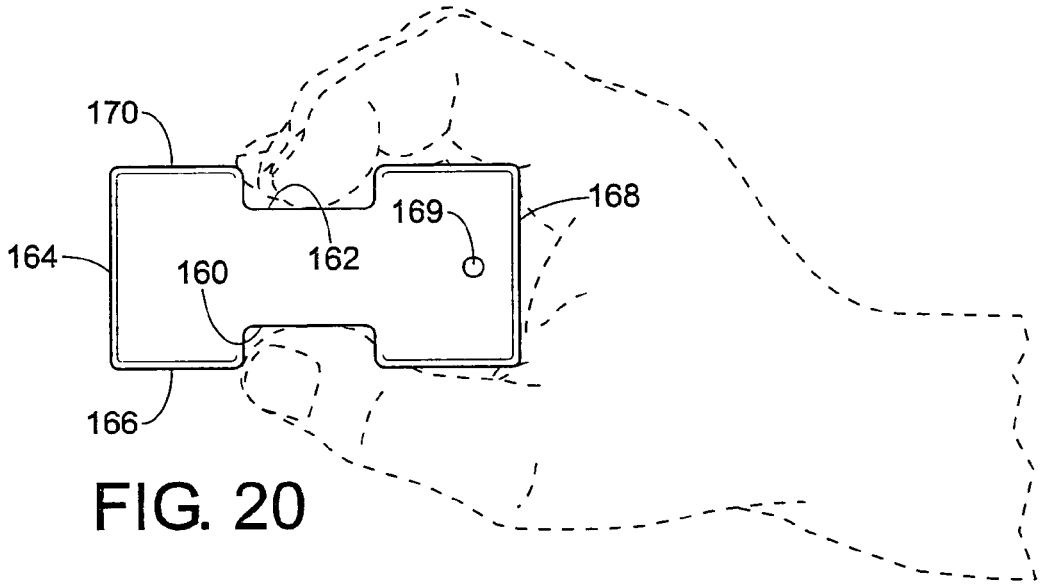

The indentations in the lid and in the cartridge body are configured to enable a user to manually grasp the cartridge with fingers and lift the cartridge out of the printer such as shown in FIG. 20. The indentations do not interfere with the printhead latch mechanism which, when closed, rests on a top surface of the lid.

Figure 18:
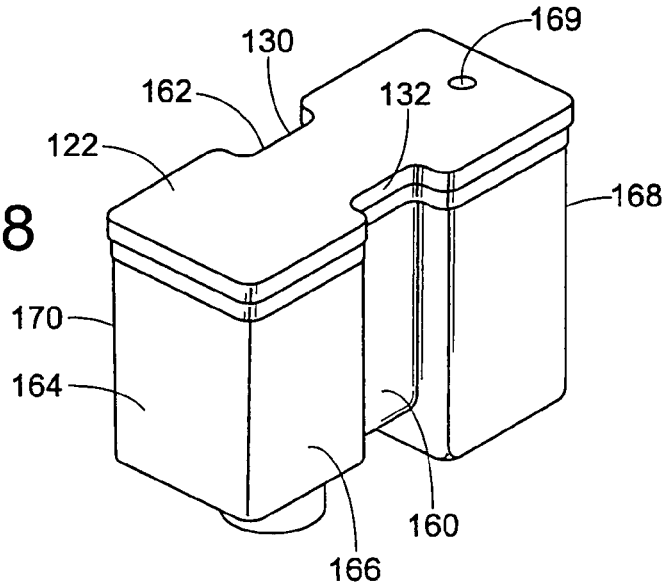
FIG. 18 is a perspective view of an ink cartridge having indentations thereon in accordance with yet another embodiment of the present invention.
Figure 19:
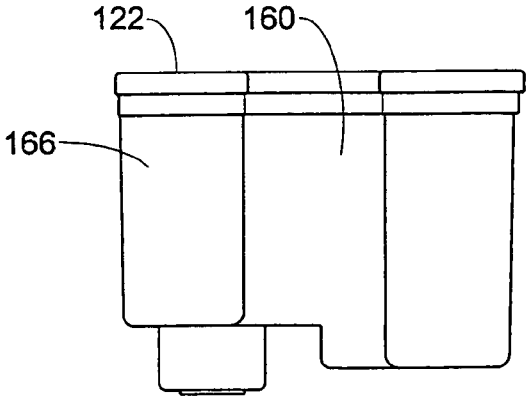
FIG. 19 is a side elevational view of the ink cartridge of FIG. 18; and, FIG. 20 is a top plan view of the ink cartridge of FIG. 18 illustrating manual gripping thereof.

Referring to FIGS. 18-20, indentations 160, 162 formed in the side walls of a cartridge can also extend the entire length of the side walls 164, 166, 168, 170. The indentations are shown to be substantially rectangular-shaped, but can be other shapes such as round or square without departing from the scope of the present invention.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An ink cartridge comprising:

a body having at least one cavity formed therein; and, a lid secured to an upper end of said body, wherein said lid comprises a pair of indentations for manually gripping the cartridge for removing said cartridge from a printhead, and said body comprises opposite side walls each having indentations, wherein each of said indentations of said body has opposite side walls extending substantially along a length of said side walls of said body, wherein said indentations in said lid form a substantially I-shaped cross-section through said lid.

2. The ink cartridge of claim 1, wherein said indentations formed in said side walls of said body of said cartridge are conformed for receiving fingers of a user for manually removing said cartridge from said printhead.

3. The ink cartridge of claim 1, wherein said indentations formed in said side walls of said body form a substantially I-shaped cross-section through said cartridge.

4. An ink cartridge comprising:

a body having a top wall, a bottom wall, and side walls connecting said top wall and said bottom wall, and a lid secured to said top wall, wherein said lid comprises a pair of indentations for manually gripping said cartridge for removal from a printhead, wherein said indentations are formed on opposite sides of said lid, and wherein said indentations formed a substantially I-shaped cross section through the lid.

5. The ink cartridge of claim 4, wherein said indentations each has side walls opposite each other and a wall connecting said side walls.

6. The ink cartridge of claim 4, further comprising indentations formed in side walls of said body of said cartridges.

7. The ink cartridge of claim 6, wherein said indentations formed in said side walls of said cartridge each has side walls and a bottom wall formed therein.

8. The ink cartridge of claim 6, wherein said indentations in said side walls form a substantially I-shaped cross section through said cartridge.

9. The ink cartridge of claim 4, wherein said indentations are conformed for receiving fingers of a user for manually removing said cartridge from said printhead.

* * * * *